US011605316B2

(12) United States Patent
Sagidullin

(10) Patent No.: US 11,605,316 B2
(45) Date of Patent: Mar. 14, 2023

(54) REFLECTIVE DECORATIVE PANEL

(71) Applicant: Denis Sagidullin, Krasnodar (RU)

(72) Inventor: Denis Sagidullin, Krasnodar (RU)

( * ) Notice: Subject to any disclaimer, the term of this patent is extended or adjusted under 35 U.S.C. 154(b) by 0 days.

(21) Appl. No.: 17/537,673

(22) Filed: Nov. 30, 2021

(65) Prior Publication Data

US 2022/0084446 A1 Mar. 17, 2022

Related U.S. Application Data

(63) Continuation-in-part of application No. 16/971,511, filed as application No. PCT/RU2020/050088 on May 4, 2020, now Pat. No. 11,217,122.

(30) Foreign Application Priority Data

Sep. 24, 2019 (RU) ..... RU2019129914

(51) Int. Cl.
*G09F 13/16* (2006.01)
*G09F 9/40* (2006.01)

(52) U.S. Cl.
CPC ..... *G09F 13/16* (2013.01); *G09F 9/40* (2013.01)

(58) Field of Classification Search
CPC ... G09F 13/16; G09F 9/40; G09F 7/06; G09F 13/165; G09F 19/02
See application file for complete search history.

(56) References Cited

U.S. PATENT DOCUMENTS 1,708,028 A * 4/1929 Pancoast ..... G09F 13/165 40/613
RE24,368 E * 10/1957 Touche ..... G09F 13/16 40/613
3,043,039 A * 7/1962 Battaglia ..... G09F 13/16 40/613
3,166,863 A * 1/1965 Gray ..... G09F 13/16 24/700
3,189,183 A * 6/1965 Thrasher ..... G09F 13/16 211/13.1
3,202,288 A * 8/1965 Thrasher ..... G09F 13/16 211/13.1
3,206,882 A * 9/1965 Thatcher ..... G08B 5/00 63/31
3,260,372 A * 7/1966 Jauslin ..... G09F 13/16 211/13.1
3,298,123 A * 1/1967 Ownbey ..... G09F 13/16 40/613

(Continued)

*Primary Examiner* — Gary C Hoge
(74) *Attorney, Agent, or Firm* — Nadya Reingand

(57) ABSTRACT

Reflective decorative panel of the present invention is the light reflecting image representation device used for production of a wide range of decorative products, advertising signs, billboards, panels, etc. The panel has a module base structure with holding elements on which reflective elements are cantilever mounted. The base structure is made in the form of a plastic lattice framework with longitudinal and transversal bearing bars, and it includes coupling elements at sides of the framework for attachment with frameworks of other modules. The coupling elements are located on edge bars at four sides of the framework. The reflective decorative panel is used for decoration of any kind of outdoor festive events, stage or TV design and facilities, where high strength and reliability of the modules attachment is of great importance.

11 Claims, 12 Drawing Sheets

(56) References Cited

U.S. PATENT DOCUMENTS

| | | | | | |
|---|---|---|---|---|---|
| 4,017,992 | A * | 4/1977 | Kajitani | G09F 13/16 | 40/439 |
| 4,080,747 | A * | 3/1978 | Kato | G09F 13/165 | 40/613 |
| RE30,822 | E * | 12/1981 | Kato | G09F 13/165 | 40/613 |
| 4,308,680 | A * | 1/1982 | Aboudi | G09F 13/16 | 428/542.2 |
| 9,601,038 | B2 * | 3/2017 | Shwed | G09F 13/165 | |
| 9,792,841 | B2 * | 10/2017 | Cowan | F16B 5/0056 | |
| 2011/0287207 | A1 * | 11/2011 | Shwed | G09F 13/165 | 428/53 |
| 2012/0182207 | A1 * | 7/2012 | Cowan | G09F 13/165 | 345/55 |
| 2014/0168983 | A1 * | 6/2014 | Opsomer | G09F 9/372 | 361/679.01 |
| 2015/0199925 | A1 * | 7/2015 | Pulos | G09F 7/18 | 40/594 |
| 2018/0374404 | A1 * | 12/2018 | Ainge | G09F 19/16 | |

* cited by examiner

View F

REFLECTIVE DECORATIVE PANEL

CROSS-REFERENCE TO RELATED APPLICATIONS

The present patent application is a Continuation-in-part of the U.S. application Ser. No. 16/971,511 filed on Aug. 20, 2020, which is the National stage application for the PCT application PCT/RU2020/050088 filed on May 4, 2020, which claims priority to Russian patent application RU2019129914 filed Sep. 24, 2019, all of which are incorporated herein in their entirety.

FIELD OF THE INVENTION

The present invention relates to the field of representation of design, advertising and construction, and more particularly to the light reflecting image representation devices used for production of a wide range of decorative products, advertising signs, billboards, panels, etc.

BACKGROUND OF THE INVENTION

The reflective decorative panel described in the utility model patent no. RU152342 includes the base structure, the means for installation of the reflective elements in the form of the posts with variable longitudinal cross-section, on which the movable reflective elements are mounted. The base structure is made in the form of a plastic lattice framework, consisting of the frame and longitudinal and transversal bearing bars, wherein on the transversal bars of the framework at the mounting points the means for securing the reflective elements are provided. When it is required to increase significantly the panel area the frameworks can be attached to each other with the help of the coupling elements by overlap fastening.

The disadvantages of the prior art include complexity of the assembly, and also insufficient reliability of engagement because such overlapped attachment requires additional fixation so as to prevent from disengagement of the panels in case of flexing a group of panels. Disassembly requires usage of the appropriate instruments.

The assembly procedure according to such prior art includes several steps:

1) the movable reflective element (MRE) is mounted on the post;

2) the post with MRE is inserted into the point of its attachment in the form of a mounting hole in the support member. The post is forced into the support member and fixed in place.

The base structure of the panel is made as a rule of strong and technologically complex polymer materials, for instance, such as ABS plastic or polycarbonate, which require high temperature for their heating and long time for cooling. Slight variation of the molding parameters can cause deformation of the products, and sometimes shrinkage of the overall dimensions of the base structure. Such features can rather seriously affect the resulting quality of the product.

The reflective decorative panel known according to the utility model patent no. RU182951 includes the base structure, being the panel module with the possibility to be attached to the other modules, made in the form of the plastic lattice framework, consisting of the frame and longitudinal and transversal bearing bars, wherein the framework includes the cantilever elements, on which the movable reflective elements (MRE) are cantilever fitted, the cantilever elements being manufactured monolithically with the framework and consist of the post, head and body, and the bodies of cantilever elements, located along the framework perimeter, include the fitting elements, provided on the reverse surface of the framework. The reflective decorative panel includes the coupling elements on the edges of the framework meant for its attachment to other frameworks, and the framework has integrally molded coupling elements for attachment to other frameworks, and such coupling elements are made as a solid bar, having the fitting element at its free end, connected with the fitting element on the body of the other framework.

The disadvantages of such type of the coupling elements are as follows: due to attachment with the body of the cantilever element fixation of the locking element is insufficient, when a group of panels is flexing the coupling elements come out of the receiving member and the panels get disengaged. In addition the coupling elements are located on the internal side of the panel, thus making disassembly of the panels rather difficult. Disassembly can be performed only with the help of appropriate tools.

The reflective decorative panel is described in the patent for invention no. RU2718657. The 1st version of such reflective decorative panel includes the base structure, which represents the panel module, with holding elements, on which the reflective elements are cantilever fitted with the help of holes, and the base structure is made in the form of a plastic lattice framework with longitudinal and transversal bearing bars, on the edges of the base structure the support members have coupling slots for attachment of the modules, according to the invention the holding elements include the support members with internal longitudinal cavities, inside of which there are provided the posts with retaining heads, and the posts are separated from the walls of the support member or connected with the walls of the support member at least with one stiffening rib. The retaining head has vertical slot for the MRE attachment, and the size of MRE hole is equal to the dimension from the face end part of the slot to the diametrically opposite edge of the base of the retaining head. The reflective decorative panel according to version 2 includes the base structure, which represents the panel module, with holding elements, on which the reflective elements are cantilever fitted with the help of holes, and the base frame is solid, monolithic, made of plastic, and the holding elements include the posts with retaining head for the MRE installation, having tapered shape towards its free end, and made integrally molded with the base structure, on the edges of the base structure the support members have coupling slots for attachment of the modules. According to the invention on the reverse side of the base structure of the panel at the points of location of the retaining head rods there are provided the coupling elements in the form of plates, integrally molded with the base structure and having a pin at the end of the coupling element. On the edges of the base structure the support members have coupling slots for attachment of the modules. The disadvantage of such known panel consists in complexity of its assembly, and also insufficient reliability of engagement as the attachment of "pin/hole" type requires additional fixation so as to prevent from disengagement of the panels in case of flexing a group of panels. Disassembly can be performed only with the help of appropriate tools.

The device for attachment of the reflective elements, described in the utility model patent no. RU183503, includes the framework, which is made hollow, flush with the base structure. Free end of the framework is beveled. The opposite sides of the framework are connected with the jumper link. In the middle part the jumper link has projection. The retaining head passes from such projection. The projection has rectangular cross-section. The projection is transferred into the retaining head. The reflective element is mounted on such projection. The reflective element has a hole of elongated ellipse shape. The technical result of such invention consists in arrangement of the reflective elements in a single plane.

The known device according to the prior art relates only to the means of attachment of the reflective element, but not to the assembly of the panel modules. In such prior art the retaining head has no tapered shape for making the panel assembly easier. The technical result of the known invention is not intended to simplify the assembly procedure, decrease the time required for the decorative panel assembly. On the contrary, when the panel is assembled with the help of such device the reflective element is mounted on the rectangular projection manually, by stringing each reflective element 7 with image coating through the retaining head 6 on the rectangular projection.

The prior art of "Shimmer disc or image apparatus and method of use thereof" according to patent application WO 2017/098226 A1 relates to the shimmer disc or image apparatus, including a support member, at least one shimmer disc or member and engagement means provided on or associated with the support member and/or shimmer disc or member for engaging at least one shimmer disc or member to the support member in use to form an engaged position. The support member, engagement means and/or at least one shimmer disc or member are arranged such that when engaged, at least part of the at least one shimmer disc or member is movable relative to the engagement means and/or support member. At least one shimmer disc or member is arranged such that at least part of the same is able to flex in use and/or is resiliently biased to the engaged position in use. The purpose of such prior art is to decrease significantly the size of the shimmer disc or member, thus allowing to create more complex structures. However such device does not resolve the problem of attaching the panels to each other.

Taking into consideration all essential features of the heretofore-known devices the closest analog for the claimed technical solution is the reflective decorative panel according to the patent for invention no. RU2718657.

The technical result of the claimed invention consists in improvement of the strength and reliability of the modules attachment for the reflective decorative panels of large sizes.

SUMMARY OF THE INVENTION

The technical result of the invention is achieved by that the reflective decorative panel, including the base structure, being the panel module, with the holding elements, on which the reflective elements are cantilever installed with the help of the holes, wherein the base structure is made in the form of the plastic lattice framework with longitudinal and transversal bearing bars and includes the coupling elements at the edges of the framework for attachment to the frameworks of other modules, and the holding elements include the posts with retaining heads for the MRE installation, having the conical shape tapered to the free end, which are integrally molded with the base structure on the bearing bars, according to the present invention has the coupling elements, located on the edge bars along four sides of the framework of the reflective decorative panel, wherein some coupling elements are locking and the other are mating means, the quantity of locking coupling elements being equal to the quantity of the mating coupling elements;

wherein the locking coupling elements of one module are able to engage with the protruding part of the mating coupling elements of the other module; and in such case the locking coupling element is molded integrally with the framework and consists of the plate, on the free end of which the female fitting element is located;

wherein the female fitting element is made as a solid body of U-cross-section and includes the symmetrical stop members, located at the both sides in the lower part of its interior surface; in such case the female fitting element has a through hole in the center of the upper part of the female fitting element; and outside on the upper part the fitting element has a bracket for force exertion during attachment or detachment of the modules;

wherein the mating coupling element is molded integrally with the edge bar of the framework and includes the projection for fixation on it of the through hole of the female fitting element, and the grooves for fixation in them of the symmetrical stop members of the fitting element during attachment of the module frameworks.

The framework bars according to the present invention have truncated spherical shape in cross-section.

The holding elements for the reflective elements according to the present invention include the support members with interior longitudinal cavities, inside of which the posts with retaining head are provided, and such posts are separated from the walls of the support member and connected with the walls of the support member at least with one stiffening rib.

The retaining head according to the present invention has a vertical slot for the MRE installation, and the size of the hole in MRE is equal to the dimension from the front end of the slot to the diametrically opposite edge of the base of the retaining head.

The size of the tapered part of the retaining head according to the present invention is less than the size of the hole in MRE.

The plate of the locking coupling element according to the present invention is a strap, molded integrally with the framework, having truncated spherical shape in cross-section.

For attachment of the modules according to the present invention there are provided separate, replaceable attachment plates, having fitting elements at the both ends of such plates.

The edge plates of the framework according to the present invention can be provided with the additional mating coupling elements for the replaceable connectors.

The reflective decorative panel according to the present invention includes the duplicating base structure in the form of flat surface used as the background for placement of monochrome or polychrome images.

The reflective decorative panel according to the present invention includes the retention means inserted into the cavity of the support member for fastening the duplicating base structure.

The reflective decorative panel according to the present invention includes the hanging means for vertical hanging of the panel assembly.

1—base structure—framework;
2—movable reflective elements (MRE);
3—holding elements;
4—longitudinal bearing bars of the framework;
5—transversal bearing bars of the framework;
6—connector;
7—connector plate;
8—female fitting element;
9—interior surface of the fitting element 8;
10—external surface of the plate;
11—stop member;
12—through hole;
13—bracket;
14—mating coupling element;
15—projection;
16—grooves;
17—holes in MRE 2.
18—cavity;
19—stiffening rib;
20—post;
21—retaining head;
22—slot of retaining head;
23—mounting hole;
24—additional mating element;
25—retention means;
26—hanging means;
27—duplicating base structure;
28—hole of duplicating base structure;
29—hole of hanging means;
30—jumper link;
31—mold flash;
32—separate coupling plate;
33—hole for fastening of framework to support surface.

DETAILED DESCRIPTION OF THE PREFERRED EMBODIMENT OF THE INVENTION

The claimed reflective decorative panel consists of the base structure 1 in the form of the lattice framework with intercrossing bars 4, 5 (FIG. 1), made of transparent polymer material, such as high-impact polystyrene, acrylic glass, monolithic polycarbonate, by means of high pressure molding.

Figure 1:
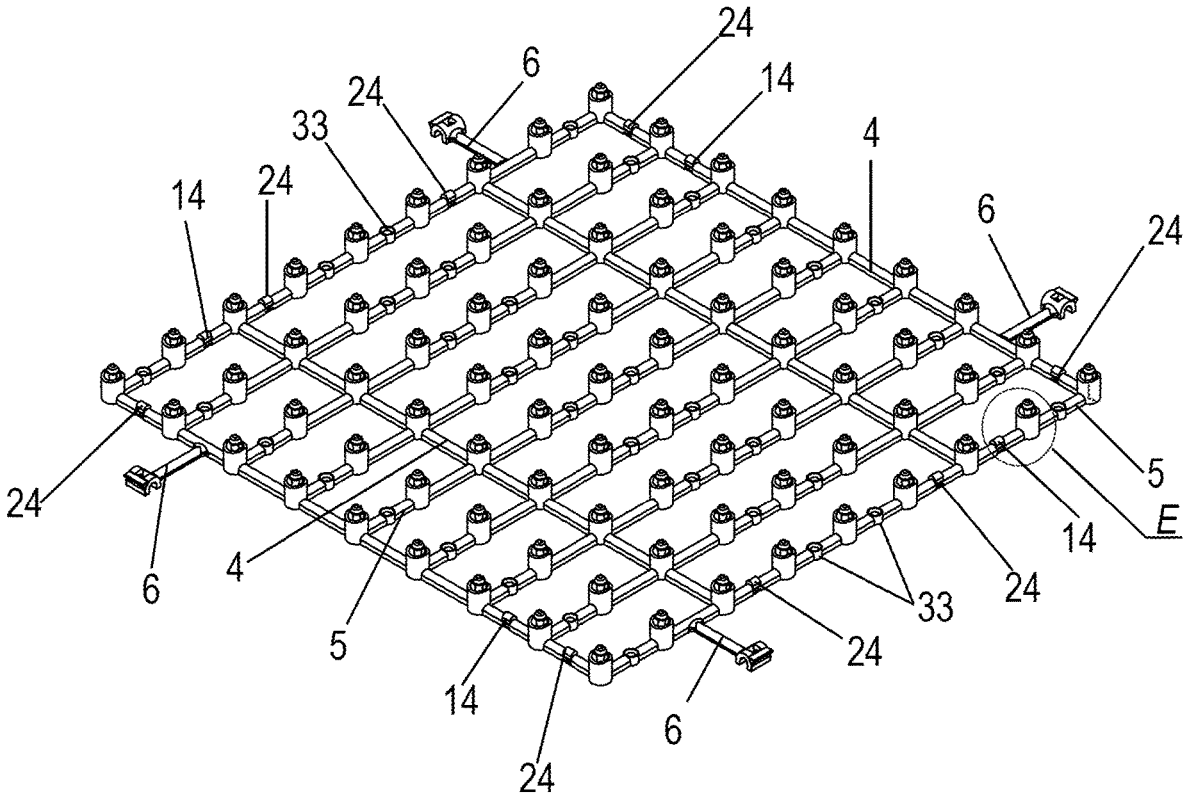
FIG. 1 General view of the panel with coupling elements.

On the framework 1 the movable reflective elements (MRE) 2 (FIG. 2) are secured with the cantilever holding elements 3 using the holes 17. The framework 1 consists of the mutually perpendicular longitudinal 4 and transversal 5 bearing bars, on which the holding elements 3 for MRE 2 fixation are provided (FIG. 1, 2). The holes 17 in MRE 2 can have any geometrical shape: circle, semi-circle, oval, polygon, etc.

The reflective elements MRE 2 are made of biaxially oriented polyester material 150-200 micron thick. Such material is characterized by high elasticity, withstands multiple deformations, has perfect initial factory memory and is capable to restore its physical properties. Such materials change their physical properties, such as thickness, density, linear stiffness, only at high temperatures—over 200 degrees.

Figure 4:
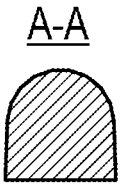
FIG. 4 Section A-A in FIG. 3.

The bars 4 and 5 represent the plates, which preferably have semi-circular cross-section (FIG. 4). Such shape is selected so as to prevent from refraction of light when looking at the product sidewise, because for rectangular shape the end-glow effect is visible at passing of the light rays through the ribs of the plates. Nevertheless, in other embodiments of the invention it is also possible to manufacture the framework plates of rectangular or trapezium cross-section.

Figure 11:
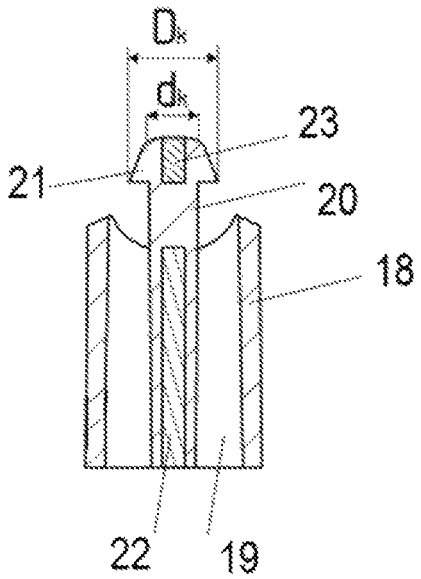
FIG. 11 Holding element 3, longitudinal section.

The holding elements 3 (FIG. 1, 2) are provided on the bearing bars 4 and 5 and include the support members 18 with interior longitudinal cavities 19, inside of which the posts 20 with retaining heads 21 are provided for installation of MRE 2. The posts 20 are separated from the walls of the support member 18 and connected with them with the help of at least one stiffening rib 22 (FIG. 11).

At the free end of the post 20 the retaining head 21 is provided for securing MRE 2 and preventing from its dropping. The retaining head 21 has frustoconical shape and includes the vertical slot 22. The slot 22 facilitates to decrease the weight both of the retaining head and of the framework in whole.

Figure 12:
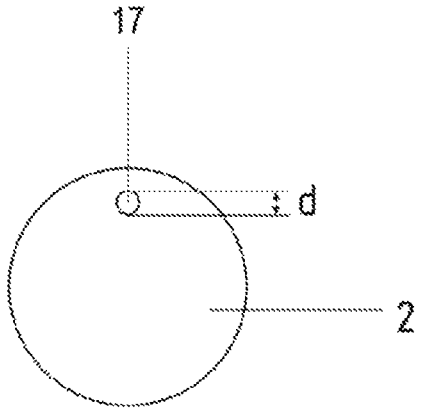
FIG. 12 Movable reflective element MRE.

Moreover, the author has found out that such shape of the retaining head 21 enables to install MRE 2 on the post 20 quickly and easily without deformations and stretching of the reflective elements. This is due to the fact that "d" size of the hole 17 in MRE 2 (FIG. 12) is equal to "a" distance from the face end part of the slot 23 to the diametrically opposite edge of the base of the retaining head 21, where:

Dk—is the diameter of the base of the retaining head;

dk—is the diameter of the end part of the retaining head;

a—is the distance from the outer circumference Dk to the slot 23.

The smaller "dk" size of the outer part of the retaining head is less than the size of the hole 17 in MRE 2. This is meant for positioning the preform with perforated reflective elements 2 as accurately as possible related to the posts 20 during assembly of the decorative panel. The larger "Dk" diameter of the base of the retaining head 21 serves to secure MRE 2.

Such construction enables to carry out replacement of the reflective elements quickly when creating multicolored mosaic images and accelerate the procedure of the decorative panel assembly.

The holding elements 3 are molded integrally with the base structure 1 from polymers, such as high-impact polystyrene, acrylic glass, monolithic polycarbonate.

The base structure 1 represents a module, which can be attached to other modules with the help of the coupling elements, located on the edge bars along four sides of the framework of the reflective decorative panel, wherein some coupling elements are locking and the other are mating elements, and the quantity of the locking coupling elements is equal to the quantity of the mating coupling elements (FIG. 1, 8). The locking coupling elements (hereinafter referred to as "the connectors") 6 are located on the edge bars along four sides of the base structure of the reflective decorative panel.

Figure 2:
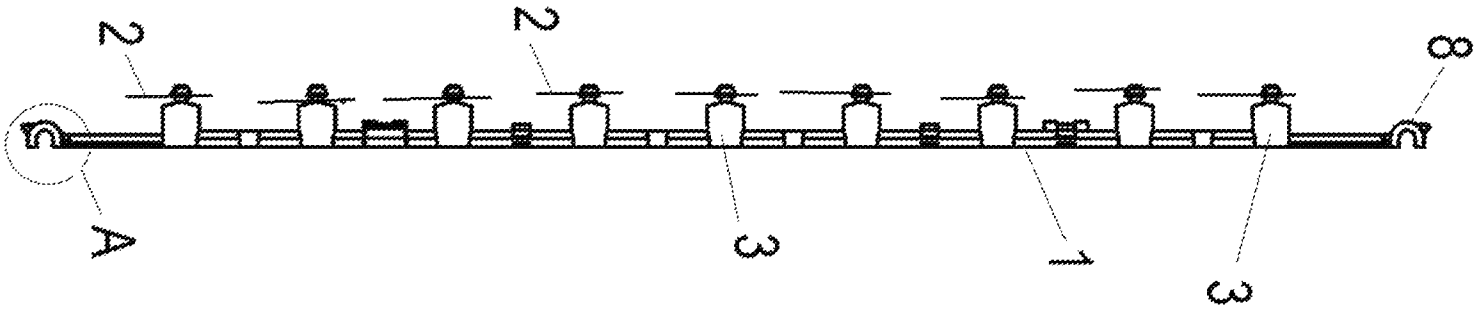
FIG. 2 Side view of the panel with MRE 2.

The connector 6 consists of the plate 7, on free end of which the female fitting element 8 is provided (FIG. 2, 3). The plate 7 is a strap, which is molded integrally with the framework, and preferably has truncated spherical shape in cross-section. (FIG. 4) similarly to the shape of the bars 4 and 5 of the framework 1.

Figure 5:
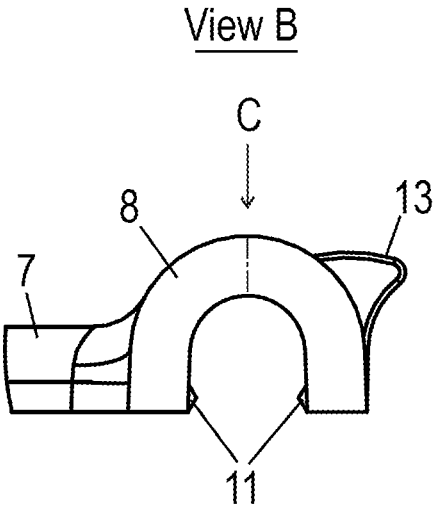
FIG. 5 View B in FIG. 2. Female fitting element.
Figure 6:
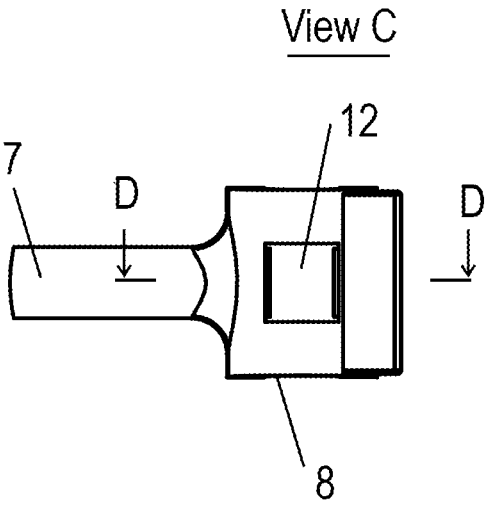
FIG. 6 View C in FIG. 5.
Figure 7:
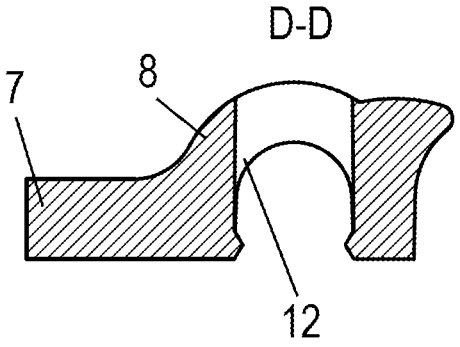
FIG. 7 Section D-D in FIG. 6

The female fitting element 8 is made in the form of a solid body with U-cross-section, representing a common rounded wall (FIG. 5).

The interior surface 9 of the fitting element 8 in the lower part is provided with the symmetrical stop members 11, located at the both sides of the interior surface 9 in the lower part of the fitting element (FIG. 5, 7). Outside the fitting element 8 in the upper part is provided with the bracket 13 (FIG. 3, 5), used as a lever for attachment or detachment of the modules by force exertion.

Figure 3:
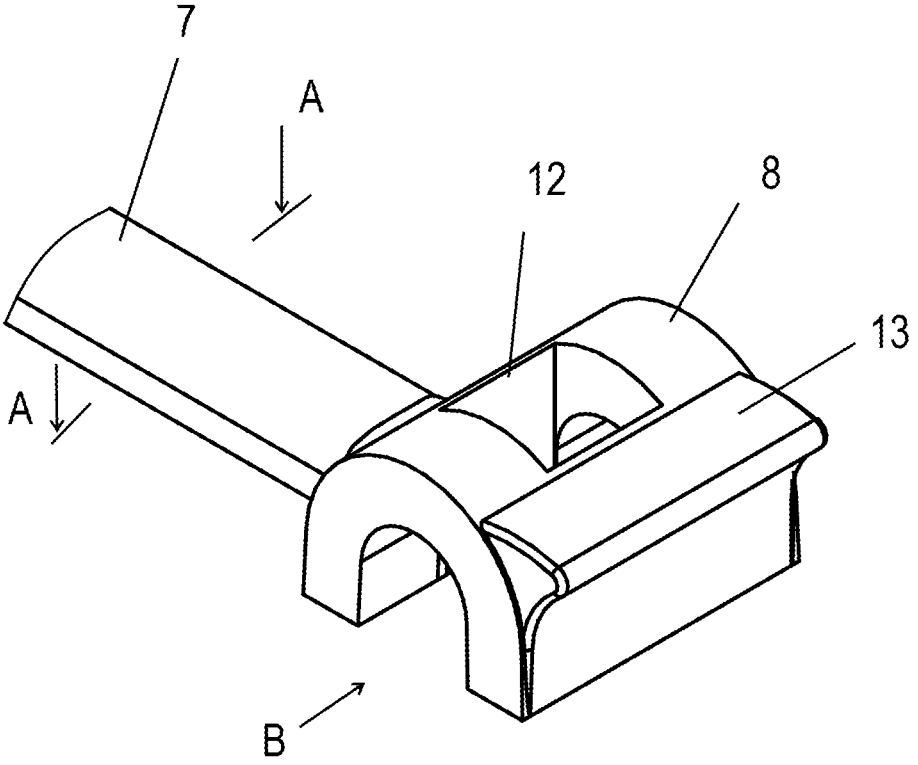
FIG. 3 View A on FIG. 2. Locking coupling element.

The female fitting element 8 has the through hole 12 in the center of the upper part of the rounded wall of the female fitting element 8 (FIG. 3, 6). The through hole 12 is provided for insertion of the protruding portion 14 of the attached module.

Figure 8:
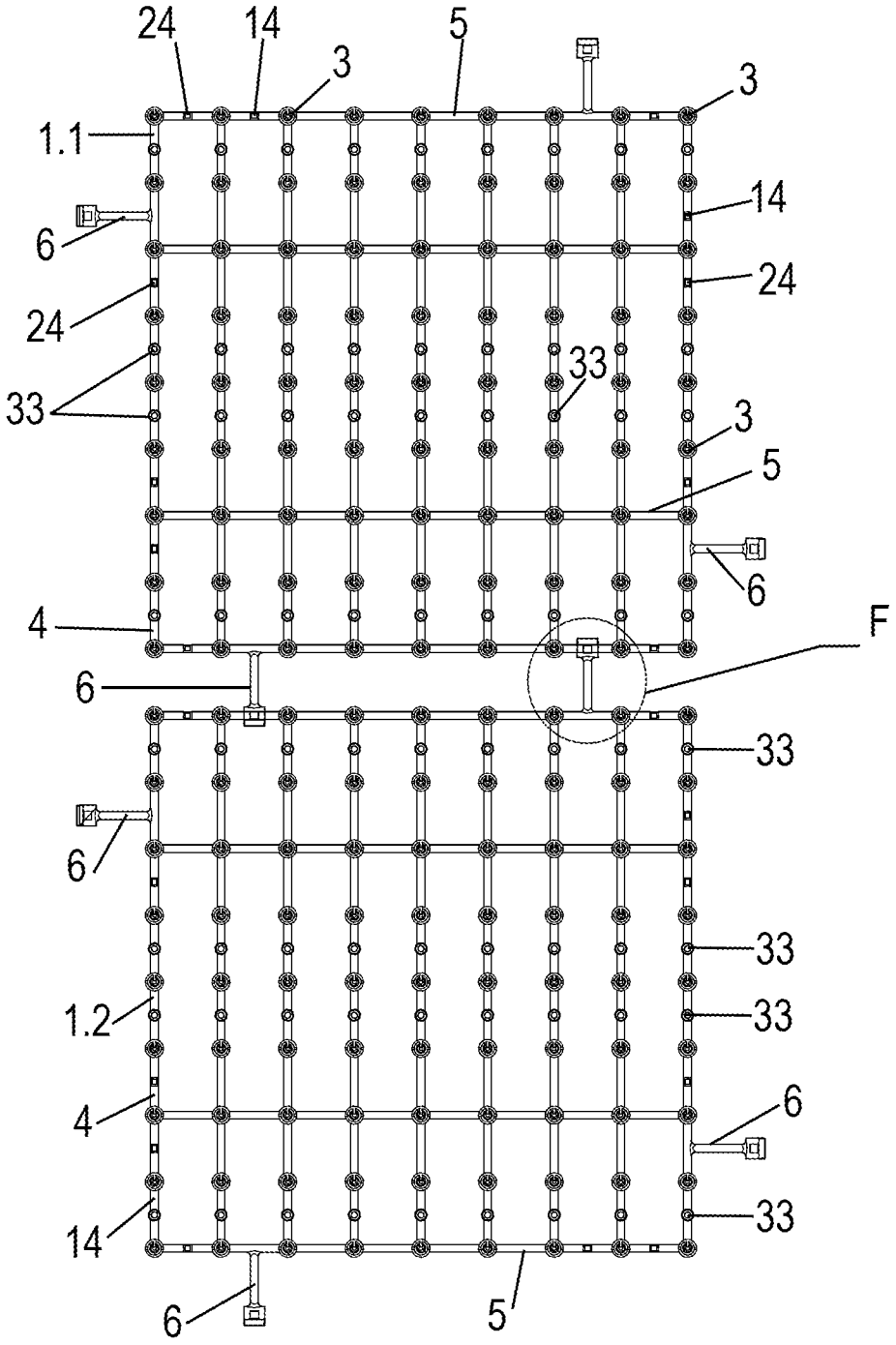
FIG. 8 Diagram of attachment for framework modules 1.1 and 1.2.

For attachment of the framework modules according to the present invention in addition to the female fitting elements 8 there are provided corresponding protruding mating portions 14, located at the edge bearing bars of the framework at the places of attachment to the connectors 6 of the other module (FIG. 8). On each edge strap of the module framework there is provided one locking connector 6 and one mating coupling element 14 (FIG. 1).

Figure 9:
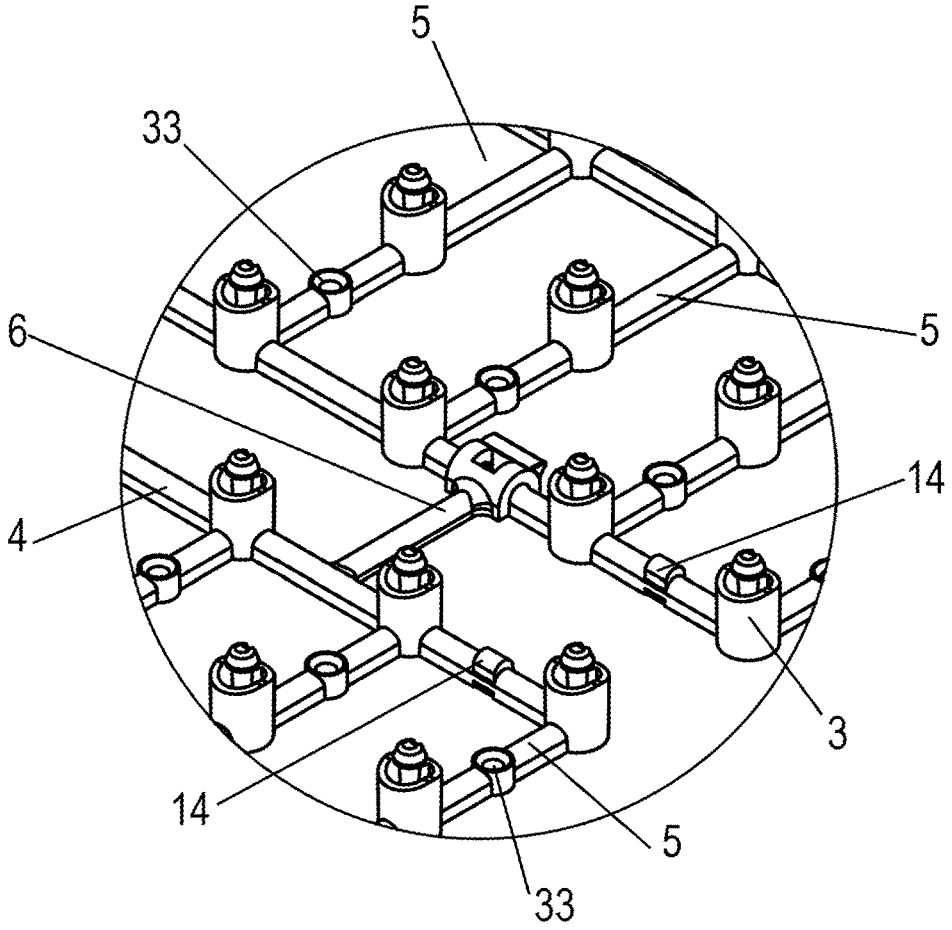
FIG. 9 Segment of the framework with locking and mating coupling elements.
Figure 10:
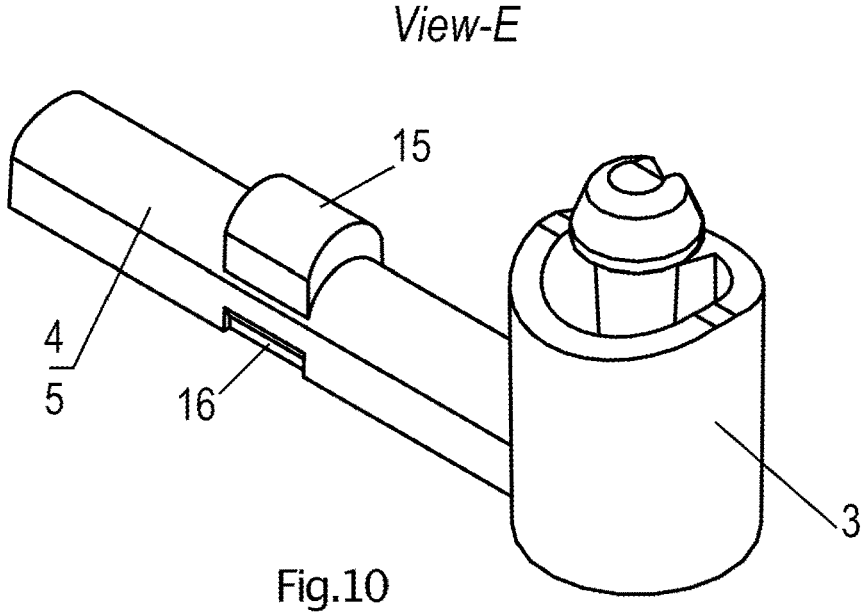
FIG. 10 View E in FIG. 1. Segment of the framework with the mating coupling element.

The mating coupling element 14 is made integrally with the framework strap and includes the projection 15 and grooves 16 (FIG. 9, 10).

The projection 15 is meant for securing the fitting element 8 on it with the help of the through hole 12 during attachment of the module frameworks. The grooves 16 are meant for fixation in them of the symmetrical stop members 11 of the fitting element 8.

Figure 21:
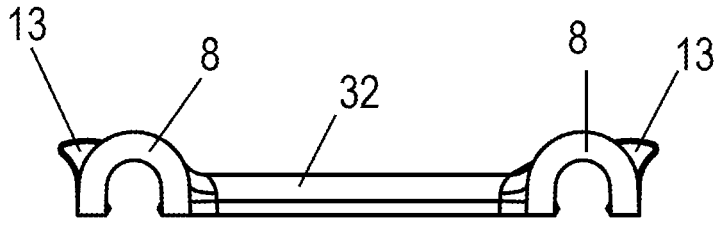
FIG. 21 Additional coupling element 32.

For attachment of the modules it is possible to use separate replaceable plates 32, having the fitting elements 8 at the both ends of the plates (FIG. 21).

At the edge plates of the framework some additional mating coupling elements 24 can be provided in case if the replaceable connectors 32 are to be used.

Figure 13:
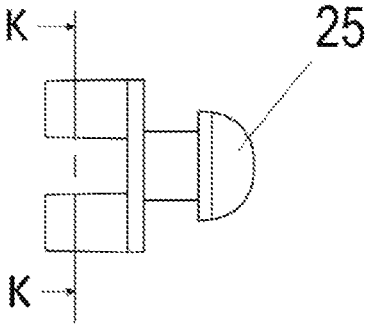
FIG. 13 Retention means 25.
Figure 14:
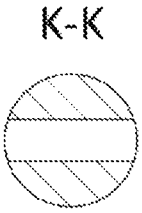
FIG. 14 Section K-K in FIG. 13.
Figure 15:
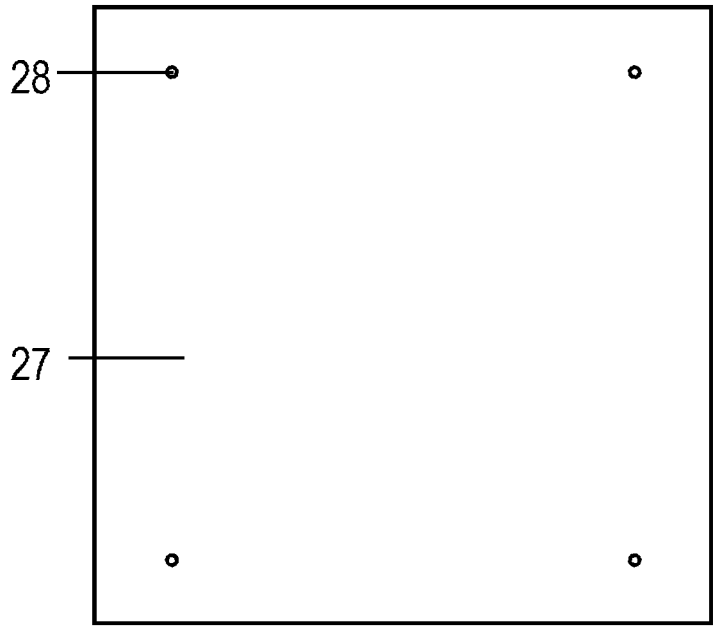
FIG. 15 Duplicating base structure.

The claimed decorative panel can include the duplicating base structure 27. For attachment of the modules 1 with the duplicating base structure 27 the panel is provided with the retention means 25 (FIG. 13, 14), which can be inserted into the cavity 19 of the support member 18 for securing the duplicating base structure. In the duplicating base structure 27 at the places of matching the base structure 1 with the duplicating base structure 27 there are provided the holes 28 (FIG. 15).

The hanging means 26 (FIG. 16, 17) are intended for hanging of the assembled panel. The base end of the hanging means is inserted with force into the cavity 19 of the support member, and into the hole 29 the wire rope is forced, which is used for hanging the decorative panel, for instance, in a store window or on any vertical surface.

The duplicating base structure 27 for the panel represents the plane with any monochrome or polychrome image on it.

The duplicating base structure 27 is preferably made of any polymer material, such as thin films of PVC or PET type. The base structure 27 can be coated with the monochrome or polychrome image, which duplicates the image produced with the help of MRE 2. The overall dimensions of the base structure 27 are the same as the outside dimensions of the base structure 1 of the panel. In the duplicating base structure 27 there are provided the holes 28 (FIG. 15) for securing the retention means 25 to the base structure 1.

The holes 28 are positioned on the duplicating base structure 27 in such a way so as during assembly the centers of the holes 28 could be aligned with the centers of the retention means 25.

For securing the framework to the support surface with such fastening means as screws, bolts there are provided the holes 33 on the bars of the framework.

Examples of Specific Embodiments

The present invention is illustrated by specific examples of its implementation, which without limitation apparently demonstrate the possibility of the invention embodiment.

Example 1. The reflective decorative panel according to version 1 includes the base structure with the holding elements, on which the reflective elements are cantilever mounted the help of the holes. The base structure is made in the form of the plastic lattice framework with longitudinal and transversal bearing straps. The holding elements 3 are molded integrally with the base structure 1 on the bearing bars 4 and 5 and consist of the support members 18 with interior longitudinal cavities 19, inside of which the posts 20 with the retaining head 21 are provided for installation of MRE 2. The posts are connected to the walls of the support member 18 with one stiffening rib 22. The retaining head 21, provided at the free end of the post 20, has frustoconical shape and includes the vertical slot 23. The size of the hole in MRE 2 corresponds to the dimension from the face end of the vertical slot 23 of the retaining head to the diametrically opposite edge of the base of the retaining head, wherein the size of the outer part of the retaining head is less than the size of the hole 17 in MRE 2. The device includes the coupling elements, located on the edge bars at four sides of the framework of the reflective decorative panel, wherein some coupling elements are locking 6 and the other are mating 14 means, and the quantities of the locking and mating coupling elements are equal.

Example 2. This embodiment of the reflective decorative panel is substantially the same as that described in example 1, wherein the posts are connected to the walls of the support member 18 with two stiffening ribs.

Example 3. This embodiment of the reflective decorative panel is substantially the same as that described in example 1, wherein the posts are connected to the walls of the support member 18 with three stiffening ribs.

Example 4. This embodiment of the reflective decorative panel is substantially the same as that described in example 1, wherein for attachment of the modules separate coupling plates 32 are used, having the fitting elements 8 at the both ends of the plates.

Example 5. This embodiment of the reflective decorative panel is substantially the same as that described in example 1, wherein the panel has the duplicating base structure in the form of flat surface used for placement of monochrome image.

Example 6. This embodiment of the reflective decorative panel is substantially the same as that described in example 1, wherein the panel has the duplicating base structure in the form of flat surface used for placement of polychrome image.

Example 7. This embodiment of the reflective decorative panel is substantially the same as that described in example 1, wherein for attachment of the modules to the duplicating base structure the panel is provided with the retention means, which are inserted into the cavity of the support member for securing the duplicating base structure. The duplicating base structure has holes at the places of alignment of the base structure with the duplicating base structure. Hanging of the panel in assembly can be performed with the help of the hanging means.

Assembly Procedure

The base structure 1 is manufactured using the high-pressure molding technique in the form of a solid framework with the holding elements 3 and connectors 6.

The modules are attached to each other by putting the female fitting element 8 of the connector 6 of one module 1.1 on the projection 15 of the mating part 14 of the other module 1.2 (FIG. 8, 20) with force exertion to the bracket 13, used as the lever for attachment and detachment of the modules. At the same time the projection 15 of the mating part is inserted into the through hole 12 of the connector 6, thus securing additional fixation due to engagement of the stop members 11 of the fitting element 8 with the grooves 16 of the mating part 14. Such engagement ensures reliable attachment of the modules as the connector 6 is secured in place and cannot disengage from the protruding mating part 14 at lateral or screw loads.

Detachment of the modules is performed by finger pressing the bracket 13. In such case the connector of one module is disengaged from the mating part 14 of the attached module: the projection 15 is released from the through hole 12, stop members 11 of the fitting element 8 are disengaged from the grooves 16 of the mating part 14.

Attachment and detachment of the modules is carried out manually, using no special tools, thus making the assembly and disassembly procedures more simple and easy.

If during service the connector 6, or fitting element 8 or mating part 14 are broken down, the replaceable connector 32 can be used.

Figure 18:
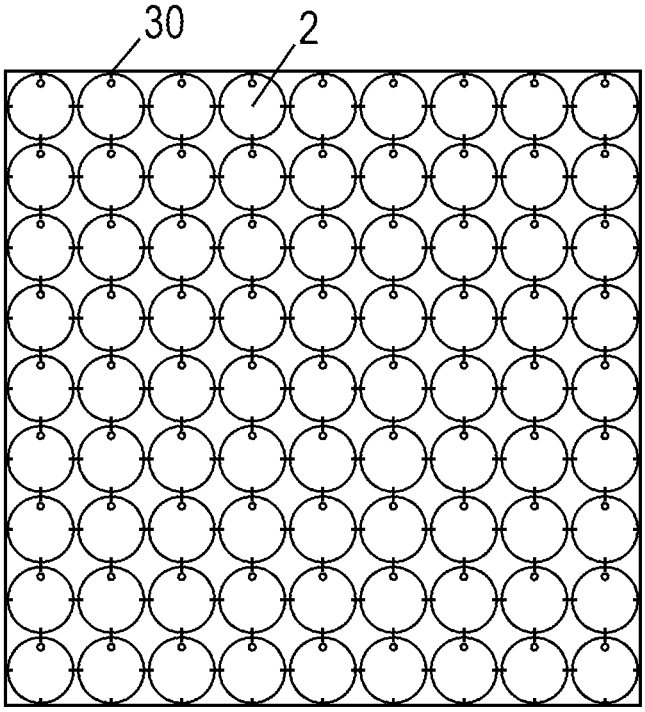
FIG. 18 Preform with MRE.

With the help of the die-stamping technique the image preform for the panel (FIG. 18) is made, including a group of MRE 2 and representing the whole image or its part, according to the project. Such preform usually has mold flash 31 resulting from extrusion of excess material from the open die or insufficient punching of the material with stamping knives.

Figure 19:
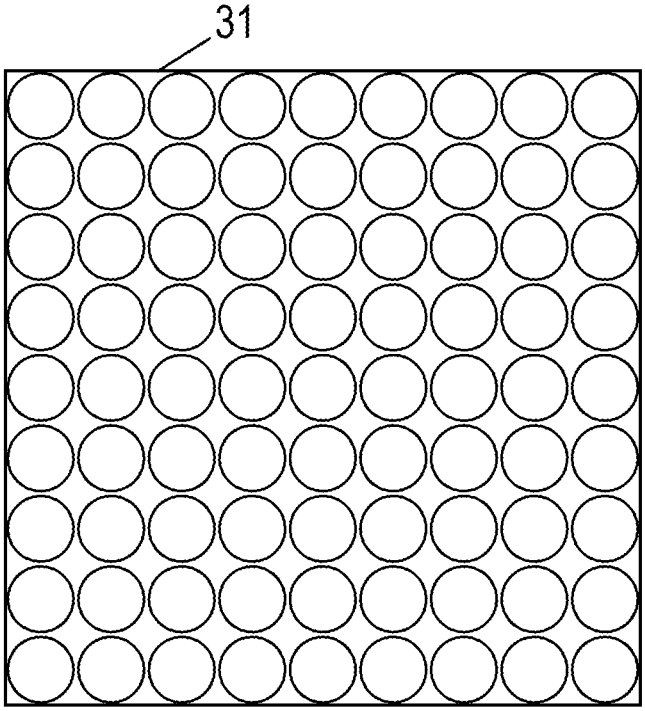
FIG. 19 Mold flash.
Figure 20:
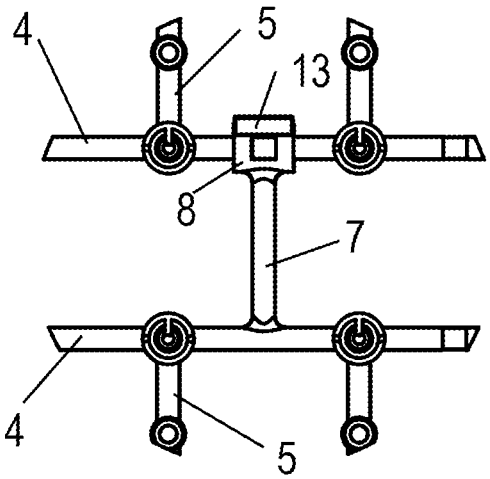
FIG. 20 View F in FIG. 8.

After stamping the preform consists of two parts: a group of MRE, interconnected with each other by means of links 30, 150-450 micron thick, at four sides of the reflective element and the mold flash 31 (FIG. 19).

The links are formed by unpunched material, meant to interconnect the preform elements and keep the waste material on the sheet. The assembly procedure includes the following steps:

1. When required, the modules of the base structure are attached to each other with the help of the coupling elements to form the panel for the whole image.
2. The preform is positioned relative to the centers of the retaining heads 21, aligning the hole 17 in MRE and the retaining head 21, and a group of MRE 2 is mounted on a group of the posts 20 of the decorative panel.
3. After installation of the preform through the retaining heads 21 on the posts 20, the remainder of mold flash 31 is removed from the preform by separating it easily from the reflective elements 2 as mold flash is usually linked with the reflective elements at four points and is only 150-400 micron thick depending of the preform density.

Figure 16:
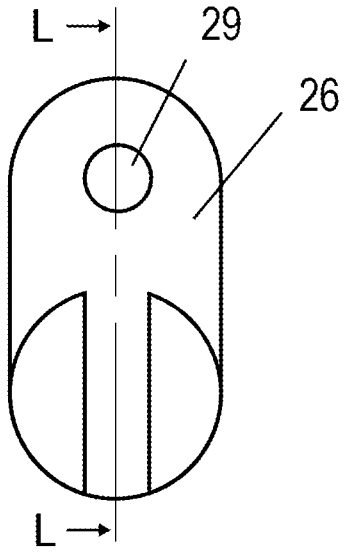
FIG. 16 Hanging means 29.
Figure 17:
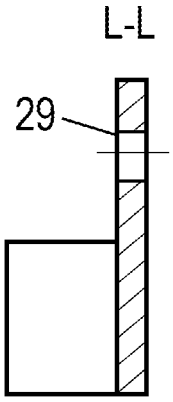
FIG. 17 Section L-L in FIG. 16.

Such light molded framework can be installed in compliance with the relevant project by its hanging or rigid or hinged mounting at the bearing structures, using the hanging means 26 (FIG. 16). The base end of the hanging means is inserted with force into the cavity 18 of the support member 3, and into the hole 29 the wire rope is forced, which is used for hanging the decorative panel, for instance, in a store window or on any vertical surface.

Rigid mounting of the framework to the bearing surface is fulfilled with the help of fixing hardware (screws, bolts), for which on the bars 4, 5 of the frameworks there are provided the holes 33.

MRE 2 are freely hanging on the posts 20, from dropping they are retained with the heads 21. Provision of the slot in the head 21 not only decreases the weight of the element, but also enables to replace promptly the reflective elements in case of their damage or when creating any complicated mosaic images, thus facilitating to fulfill assembly of the decorative panel faster.

Decrease of the weight reduces consumption of the materials for the product and lowers the cost of production.

INDUSTRIAL APPLICABILITY

The reflective decorative panel can be used for decoration of any outdoor festive events, stage or TV design and facilities, for manufacturing 3D objects and structures for games, entertainments and public events, signboards, demonstration stands, advertising and other decorative products, preferably of large size, where high strength and reliability of the modules attachment is of great importance.

What is claimed is:

1. A reflective decorative panel, including: a base structure, which represents a module panel, with holding elements, on which reflective elements are cantilever mounted with a help of holes, wherein the base structure is made in a form of a plastic lattice framework with longitudinal and transversal bearing bars and includes coupling elements at sides of the framework for attachment with frameworks of other modules, and the holding elements include posts with a retaining head for a movable reflective element (MRE) installation, the retaining head having a conical shape, tapered towards a free end, and molded integrally with the base structure on the bearing bars, wherein the coupling elements are located on edge bars at four sides of the framework of the reflective decorative panel, wherein some coupling elements are locking coupling elements and other are mating coupling elements;

wherein the locking coupling elements of one module engage with protruding parts of the mating coupling elements of another module; and the locking coupling element is molded integrally with the framework and includes a plate, on free end of which a female fitting element is provided;

wherein the female fitting element is made in a form of a solid body with an U-cross-section and includes symmetrical stop members, located at both sides in a lower part of its interior surface; and the female fitting element has a through hole in a center of an upper part of the female fitting element; and outside on the upper part the female fitting element has a bracket for force exertion during attachment or detachment of the modules;

wherein the mating coupling element is molded integrally with the edge bar of the framework and includes a projection for fixation on it of a through hole of the female fitting element, and grooves for fixation in them of symmetrical stop members of the fitting element during attachment of the module frameworks.

2. The reflective decorative panel according to claim 1, wherein the bars of the framework have truncated spherical shape in cross-section.

3. The reflective decorative panel according to claim 1, wherein the holding elements for the reflective elements include a support member with interior longitudinal cavities, inside of which posts with retaining heads are provided, and the posts are separated from walls of the support member and connected with walls of the support member at least with one stiffening rib.

4. The reflective decorative panel according to claim 1, wherein the retaining head has a vertical slot for MRE installation, and a size of a hole in MRE is equal to a dimension from a front end of the slot to diametrically opposite edge of a base of the retaining head.

5. The reflective decorative panel according to claim 1, wherein a size of a tapered part of the retaining head is less than the size of the hole in MRE.

6. The reflective decorative panel according to claim 1, wherein a plate of the locking coupling element represents a strap, molded integrally with the framework, having truncated spherical shape in cross-section.

7. The reflective decorative panel according to claim 1, wherein for attachment of the modules there are provided separate, replaceable attachment plates, having fitting elements at both ends of the plates.

8. The reflective decorative panel according to claim 1, wherein the edge plates of the framework are provided with additional mating coupling elements for replaceable connectors.

9. The reflective decorative panel according to claim 1, wherein the panel includes a duplicating base structure in a form of flat surface used for placement of monochrome or polychrome images.

10. The reflective decorative panel according to claim 1, wherein the panel includes retention means inserted into a cavity of the support member for fastening the duplicating base structure.

11. The reflective decorative panel according to claim 1, wherein the panel includes hanging means for vertical hanging of the reflective decorative panel in assembly.

* * * * *